US005465492A

United States Patent [19]

Bond

[11] Patent Number: 5,465,492

[45] Date of Patent: Nov. 14, 1995

[54] ALIGNMENT DEVICE FOR A HAND TOOL

[75] Inventor: Robert F. Bond, Exeter, United Kingdom

[73] Assignee: Five Star Enterprises Limited, Channel Islands

[21] Appl. No.: 256,316

[22] PCT Filed: Jan. 15, 1993

[86] PCT No.: PCT/GB93/00099

§ 371 Date: Jul. 7, 1994

§ 102(e) Date: Jul. 7, 1994

[87] PCT Pub. No.: WO93/13914

PCT Pub. Date: Jul. 22, 1993

[30] Foreign Application Priority Data

Jan. 16, 1992 [GB] United Kingdom ..... 9200926

[51] Int. Cl.[6] ..... B27G 23/00

[52] U.S. Cl. ..... 33/275 R; 33/638; 33/626

[58] Field of Search ..... 33/1 N, 286, 275 R, 33/438, 533, 534, 626, 630, 636, 638, 639, 642, 645

[56] References Cited

U.S. PATENT DOCUMENTS

| | | | |
|---|---|---|---|
| 2,407,845 | 9/1946 | Nemeyer | 116/200 |
| 2,483,060 | 9/1949 | Niedelman et al. | 33/638 |
| 3,707,043 | 12/1972 | Jones | 33/642 |
| 4,193,203 | 3/1980 | LeGrand et al. . | |

FOREIGN PATENT DOCUMENTS

| | | | |
|---|---|---|---|
| 2653046 | 4/1991 | France . | |
| 1077442 | 3/1960 | Germany | 33/638 |
| 2306040 | 8/1974 | Germany . | |
| 2053750 | 2/1983 | United Kingdom . | |

*Primary Examiner*—William A. Cuchlinski, Jr.
*Assistant Examiner*—G. Bradley Bennett
*Attorney, Agent, or Firm*—Ira S. Dorman

[57] ABSTRACT

The device has a fixed rod 15 aligned with the working axis of the tool, e.g. a pistol drill. The rod 15 is in spring biassed, telescopic sliding engagement with a tube 16 fixed to an indicator head 17. The head 17 includes a universal-type pivotal coupling and bears indicia to indicate when the axis of the rod 15 is perpendicular to a work surface against which the head 17 bears. The rod 15 carries a depth gauge scale 19, and an adjustable stop 20 determines the maximum depth of penetration of the drill bit into the workpiece.

6 Claims, 2 Drawing Sheets

ALIGNMENT DEVICE FOR A HAND TOOL

TECHNICAL FIELD OF THE INVENTION

This invention relates to manually manipulated tools for driving an element such as a drill bit, stud or fastener along a drive axis into the surface of a workpiece. More particularly, the invention concerns a device for providing a visual indication of the angular disposition of the drive axis relative to the surface.

BACKGROUND

When using such tools it is usually necessary to maintain the working axis of the tool at a certain angular relationship (usually perpendicular) to the surface of a workpiece. In the case of a drill bit for example, the bit must be maintained at this angle throughout the entire drilling operation.

U.S. Pat. No. 3,707,043 and GB 2 053 750 both disclose an indicator device having:

a head arranged to be supported in a stable position on a workpiece surface adjacent to the position at which an element is to be driven into said surface, said head including a socket having a part-spherical bearing surface; and coupling means having a first portion for attachment to the tool and a second portion in sliding engagement with said first portion to move in a direction which is parallel to the drive axis of the tool, said second portion having a part-spherical bearing surface which is closely received in said socket to form a universal-type pivotal coupling.

In both of these earlier proposals the head is coupled to a remote indicator arrangement disposed adjacent to the tool, to indicate when the drive axis of the tool is perpendicular to the workpiece surface. There is a serious risk of swarf and other debris becoming lodged in the coupling arrangement, which would seriously impair the operation of the device. In addition, the user is not able to focus simultaneously on the indicator and the workpiece surface, making the device difficult to use.

An aim of the present invention may be viewed as being to eliminate these drawbacks of the earlier devices.

SUMMARY OF THE INVENTION

The present invention proposes that the part-spherical bearing surfaces are provided with indicia means for indicating the angular disposition of said drive axis relative to said workpiece surface.

The provision of indicia directly on the bearing surfaces has the following advantages:

1. The construction of the device can be simplified, with less risk of failure due to dirt contamination.
2. The visual indication is closer to the workpiece surface, so that both are simultaneously within the field of vision of the user.
3. The visual indication can be more accurate.
4. The cost of the device is reduced.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
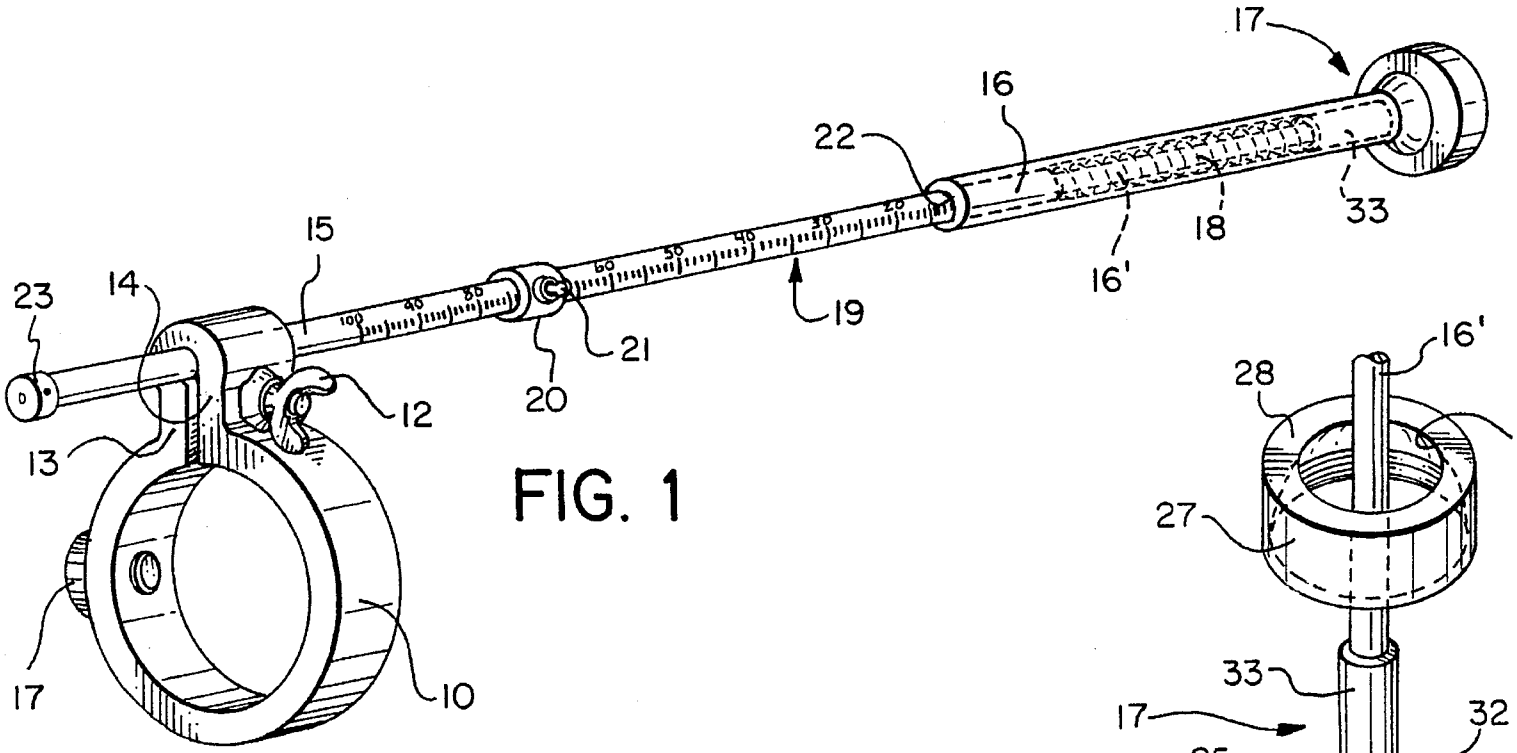
FIG. 1 is a general view of an indicator device of the invention.

Referring to FIG. 1, the device includes a split clamp ring 10 which is dimensioned to fit about the handle boss of a standard pistol grip power drill (not shown). The clamp ring has a fixing boss 11 for attachment of an auxiliary handle, and is secured to the drill by tightening a clamping nut and bolt 12 to draw together the ends 13 and 14 of the clamp ring.

A tubular rod 15 is inserted between the ends 13 and 14 to extend parallel to the drive axis about which the drill bit rotates. The clamping nut 12 can be slackened sufficiently to permit the rod 15 to be axially adjusted relative to the ring 10, and the nut tightened to lock the rod in position. An outer tube 16 is a close sliding fit on one end of the rod 15 to carry an indicator head 17. A guide rod 16' (FIG. 2) slidably extends from the head 17 through the tube 16 and tubular rod 15. The tube 16 contains a compression spring 18, located about the guide rod 16', which acts against the rod 15 to urge the head 17 away from the tool. The spring thus returns the head 17 to a datum position shown, determined by engagement of a stop 23 on the opposite end of guide rod 16' with the end of tubular rod 15. The rod 15 carries a depth gauge scale 19 which co-operates with the end face 22 of the tube 16 so that when the head 17 is urged axially towards the clamp ring 10 the distance moved from the datum position can be read off on the scale. A depth stop 20 is slidably received about the rod 15 and its axial position can be set by a screw 21. Thus, abutment of the end face 22 with the depth stop 20 determines the maximum range of movement of the head 17.

Figure 2:
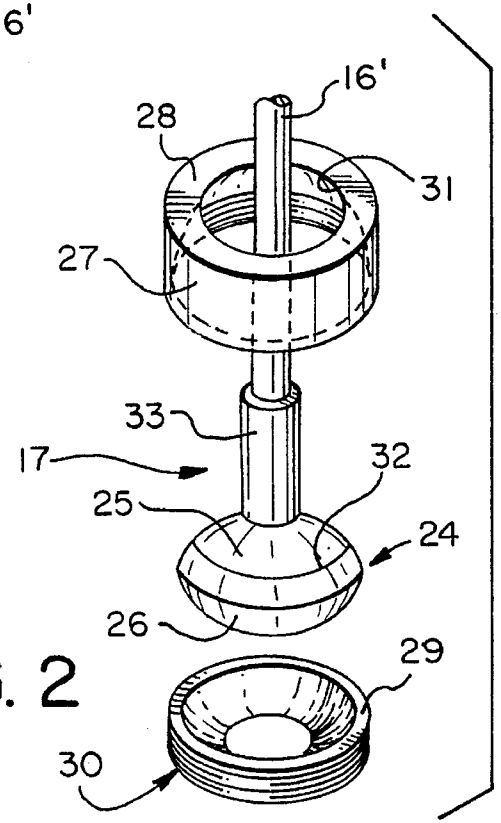
FIG. 2 is a general exploded view of the indicator head of the device.
Figure 3A:
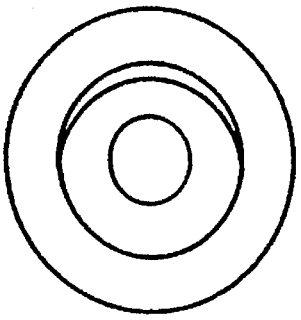
FIGS. 3(*a*) to (*f*) are plan views of the indicator head under various conditions.
Figure 3B:
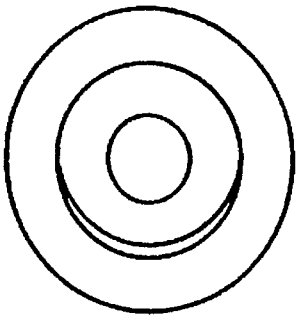
Figure 3C:
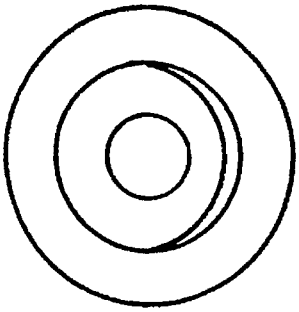
Figure 3D:
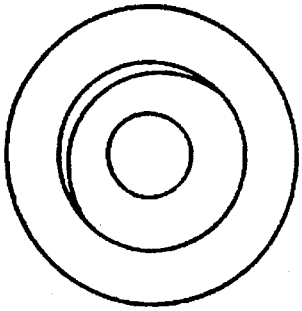
Figure 3E:
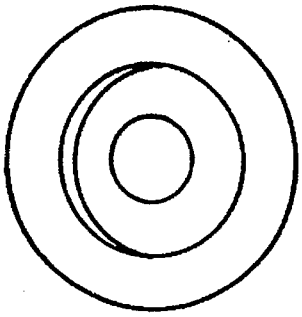
Figure 3F:
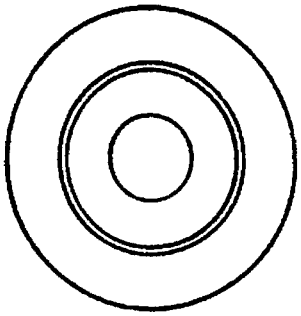

Referring to FIG. 2, the head 17 includes a body 24 having a pair of conjoined, part-spherical bearing surfaces 25 and 26, one of which 25 is joined centrally to one end of the guide rod 16'. The outer slide tube 16 (not shown in FIG. 2) is secured onto an enlarged end 33 of the rod 16'. A short cylindrical outer housing 27 receives the body 24 with the tube 16 projecting through one end face 28. The opposite end of the housing is closed by a screw-in end cap 29 to provide a flat undersurface 30. The housing 27 is dimensioned to receive the body 24 as a close-fitting universal-type pivotal coupling. The internal surface of the housing which is opposed to the surface 25 is of complementary part-spherical shape, and meets the outer end face 28 at a circular edge 31. In addition, a circular ring 32, of marginally smaller diameter than edge 31, is inscribed on the surface 25 of head 24, concentric with tube 26.

When a drill bit is secured in the drill chuck the rod 15 is adjusted in the clamp ring 10 so that the undersurface 30 of the head 17 is substantially coterminous with the tip of the bit. The depth stop 20 can then be set to the required depth of the hole which is to be drilled, as read off on the scale 19. The drill tip and undersurface 30 are then placed on the surface of the workpiece to be drilled. If the axis of the drill bit is non-perpendicular with respect to the workpiece surface, the ring 32 will appear non-concentric with the edge 31, as in FIGS. 3(*a*) to (*e*), but when perpendicularity is achieved the two rings will be concentric as in FIG. 3(*f*). Provided concentricity is maintained throughout the drilling operation the hole will be drilled accurately perpendicular to the workpiece. When the end face of tube 16 abuts the depth stop 20 the required depth of hole has been achieved.

It will be appreciated that a hole can be drilled at any required angle to the workpiece surface, if required, by maintaining a constant relationship between the mark 32, and edge 31 throughout the drilling operation.

Since there is no clearance between the part-spherical surface 25 and the edge 31 there is no risk of dirt entering the housing 27.

The ring 32 could be the same size, or smaller than the edge 31. The surface 25 of body 24 could be provided with other markings to indicate when the tube 16 is centralised with respect to the edge 31, e.g. four short radial lines arranged to intersect the edge at 90° intervals. Perpendicularlity will be achieved when the visible portions of the lines are all of the same length. The housing 27 could also be transparent and bear suitable markings for alignment with markings on the body 24.

The undersurface 30 need not necessarily be flat. It could, for example, have three, or more, points of contact with the surface of the workpiece.

A drill or other tool could be manufactured to receive the rod 5 instead of using the ring 1 to attach the device.

I claim:

1. For use with a manually manipulated tool for driving an element along a drive axis into a workpiece surface, an indicator device for indicating the angular disposition of said drive axis relative to said workpiece surface, said indicator device having:

a head arranged to be supported in a stable position on said workpiece surface adjacent to the position at which said element is to be driven into said workpiece surface, said head including a socket having a part-spherical bearing surface; and coupling means having a first portion for attachment to said tool and a second portion in sliding engagement with said first portion to move in a direction which is parallel to said drive axis, said second portion having a part-spherical bearing surface which is closely received in said socket to form a universal-type pivotal coupling, characterised in said part-spherical bearing surfaces are provided with indicia means for indicating the angular disposition of said drive axis relative to said workpiece surface, said indicia means being so located on said bearing surfaces as to be readily visible when viewed from a point substantially on said drive axis.

2. An indicator device in accordance with claim 1, in which said convex part-spherical bearing surface is fixed with the second portion of said coupling means.

3. An indicator device according to claim 2, in which the second portion of said coupling means, in sliding engagement with the first portion, projects through said aperture.

4. An indicator device according to claim 1, in which said indicator markings comprise a circle of the same or smaller diameter than a circular edge of said aperture.

5. An indicator device according to claim 1, in which said coupling means comprises a depth gauge scale.

6. An indicator device according to claim 1, in which said coupling means comprises adjustable stop means for determining the range of movement of the first and second portions thereof.

* * * * *